US009138611B2

(12) United States Patent
Towley, III

(10) Patent No.: US 9,138,611 B2
(45) Date of Patent: Sep. 22, 2015

(54) SELECTORIZED DUMBBELL HAVING AN UPPER SELECTOR AND WEIGHTS FORMED BY LATERALLY SPACED WEIGHT PLATES JOINED BY THIN CONNECTING WALLS

(71) Applicant: Carl K. Towley, III, Sebastian, FL (US)

(72) Inventor: Carl K. Towley, III, Sebastian, FL (US)

(73) Assignee: PowerBlock Holdings, Inc., Owatonna, MN (US)

( * ) Notice: Subject to any disclaimer, the term of this patent is extended or adjusted under 35 U.S.C. 154(b) by 22 days.

(21) Appl. No.: 14/200,246

(22) Filed: Mar. 7, 2014

(65) Prior Publication Data

US 2014/0274597 A1 Sep. 18, 2014

Related U.S. Application Data

(60) Provisional application No. 61/779,784, filed on Mar. 13, 2013.

(51) Int. Cl.

| | |
|---|---|
| ***A63B 21/00*** | (2006.01) |
| ***A63B 21/075*** | (2006.01) |
| ***A63B 21/072*** | (2006.01) |
| *A63B 21/06* | (2006.01) |

(52) U.S. Cl.

CPC ..... *A63B 21/075* (2013.01); *A63B 21/0726* (2013.01); *A63B 21/0605* (2013.01)

(58) Field of Classification Search

CPC ..... A63B 21/00
USPC ..... 482/106, 108, 107, 93, 94, 95
See application file for complete search history.

(56) References Cited

U.S. PATENT DOCUMENTS

| | | | | |
|---|---|---|---|---|
| 5,769,762 | A | 6/1998 | Towley, III et al. | |
| 7,011,611 | B1 * | 3/2006 | Ripley | 482/107 |
| 7,153,244 | B2 | 12/2006 | Towley, III et al. | |
| 7,854,693 | B2 | 12/2010 | Towley, III et al. | |

* cited by examiner

*Primary Examiner* — Jerome w Donnelly
(74) *Attorney, Agent, or Firm* — James W. Miller

(57) ABSTRACT

A selectorized dumbbell has a plurality of nested weights which each have a box-shaped configuration comprising spaced left and right weight plates joined by planar, substantially imperforate, front and rear walls. The front and rear walls of the nested weights are very thin in comparison to the weight plates, extend over substantially the full height of the weight plates, and are joined to the weight plates along substantially their entire height. A selector comprises a pair of connecting members that coact between a handle of the dumbbell and upper portions of the front and rear walls of the nested weights to select a desired number of the weights for use with the handle depending upon the selected positions of the connecting members.

13 Claims, 9 Drawing Sheets

SELECTORIZED DUMBBELL HAVING AN UPPER SELECTOR AND WEIGHTS FORMED BY LATERALLY SPACED WEIGHT PLATES JOINED BY THIN CONNECTING WALLS

TECHNICAL FIELD

This invention relates to a selectorized dumbbell having a selector that the user can manipulate to adjust the exercise mass of the dumbbell by coupling a desired number of weights from among a plurality of nested weights to a handle of the dumbbell.

BACKGROUND OF THE INVENTION

Selectorized dumbbells are known which allow the user to easily adjust the amount of the exercise mass coupled to the handle. This is done by the manipulation or repositioning of a selector to change the number of weights that are coupled to the handle from among a plurality of nested weights that are available to be so coupled. This avoids having to purchase and store an entire set of dumbbells in different weights, e.g. a pair of 5 lb. dumbbells, a pair of 10 dumbbells, etc. This also avoids having to individually slide more weight plates onto or off of each end of a bar type dumbbell handle in order to increase or decrease, respectively, the exercise mass of the dumbbell.

One type of selectorized dumbbell is shown in U.S. Pat. No. 5,637,064 issued to the Applicants hereof. In this selectorized dumbbell, one weight plate is joined to a second laterally spaced weight plate by a front rail connected at either end to the front sides of the weight plates and by a rear rail connected at either end to the rear sides of the weight plates. The front and rear rails joining the pair of weight plates are at the same vertical elevation relative to one another. Thus, a single weight used in the selectorized dumbbell is formed by the pair of weight plates and by the pair of rails used to join the weight plates together.

In this selectorized dumbbell, a plurality of weights of the type described above are used which weights are generally identical to one another except in two respects. First, the lateral spacing between the weight plates from one weight to another progressively increases as one goes from an innermost weight to an outermost weight, thus causing the front rails to progressively increase in length in a like manner. Second, as one goes from an innermost weight to an outermost weight, the rails lower in height with the rails on the innermost weight being the highest, the rails on the outermost weight being the lowest, and the rails on the weights in between being at progressively different heights between the highest and lowest heights. This allows the weights to be nested together with the weight plates on a first end of the rails, namely the left weight plates, being stacked together and spaced from the stacked weight plates on the second end of the rails, namely the right weight plates, such that a gap is provided between the stacks of left and right weight plates. In this design, the front and rear rails are stacked on top of another along the front and rear sides of the weight plates in front and rear vertical rail arrays.

The handle of the dumbbell has a pair of spaced ends that carry a vertical array of slots therein. The slots are located in alignment with vertical spaces between the adjacent rails when the handle is dropped down and inserted into the gap between the stacks of left and right weight plates. The handle carries a hand grip that is perpendicular to the handle ends and perpendicular to the direction of the slots.

A U-shaped connecting pin is inserted beneath the front rails of a selected weight with the prongs of the U-shape entering into a pair of slots in the opposite ends of the handle. The prongs will extend through fully through such slots as the user fully pushes the connecting pin into the handle. The amount of exercise mass coupled to the handle is determined by which of the spaces beneath the rails receives the connecting pin. When coupled in this manner, the handle will lift an exercise mass comprising both the weight whose rails are immediately above the connecting pin and any other weights that are above the selected weight. The exercise mass can thus be easily adjusted by moving the connecting pin upwardly or downwardly to the spaces beneath the rails of different weights before pushing the connecting pin inwardly.

While a selectorized dumbbell of this type is very effective and easy to use, the front and rear rails must be robust enough to carry the spaced weight plates in a durable manner. Typically, the rails comprise steel bar stock of at least a ¼" in diameter. In addition, each end of the rail must be welded to either the front or rear side of each weight plate. Thus, there are four welds required when manufacturing each weight. Thus, this style of weight can be somewhat costly to manufacture.

In addition, the insertion of the connecting pin into the handle beneath the lowermost rails, i.e. the rails of the outermost weight in which the laterally spaced weight plates are the furthest apart, can be somewhat difficult given the small clearance between the space beneath such rails and a support surface on which the nested weights of the dumbbell are resting. The user must take care to ensure that the connecting pin is almost perfectly horizontal before attempting to push it into the slots in the handle that are aligned with the space beneath the rails on the outermost weight. In addition, the center of gravity of the dumbbell lowers as more weights are added to the handle due to the added mass of the front and rear rails of the added weights. This change in the center of gravity can be felt by the user and is undesirable.

It would be better if the weight distribution of the dumbbell felt the same in the user's hand regardless of how many weights were coupled to the handle. Thus, it would be a further advance in the art to provide a selectorized dumbbell that had an improved, more easily usable selector and that had a consistent center of gravity regardless of the numbers of weights coupled to the handle.

SUMMARY OF THE INVENTION

One aspect of this invention relates to a selectorized dumbbell which comprises a handle, a plurality of nested weights, and a selector for selectively coupling a desired number of weights to the handle depending upon a position of the selector relative to the nested weights and handle. Each weight has a box-shaped configuration defined by a left weight plate and a right weight plate joined together by substantially planar and substantially imperforate front and rear connecting walls. Each of the front and rear connecting walls of each weight has a height that extends substantially over a full height of the weight plates of each weight. The front and rear connecting walls are joined to front and rear edges, respectively, of the weight plates. The box-shaped configurations of the plurality of nested weights have progressively decreasing sizes that allow the box-shaped configurations to be nested inside of one another with the left weight plates being stacked adjacent one another, with the right weight plates being stacked adjacent one another, with the front connecting walls being stacked adjacent one another, and with the rear connecting walls being stacked adjacent one another.

Another aspect of this invention relates to a selectorized dumbbell which comprises a handle, a plurality of nested weights, and a selector for selectively coupling a desired number of weights to the handle depending upon a position of the selector relative to the nested weights and handle. Each weight has a box-shaped configuration defined by a left weight plate and a right weight plate joined together by substantially planar front and rear connecting walls. Each of the front and rear connecting walls of each weight has a height that extends substantially over a full height of the weight plates of each weight. The front and rear connecting walls of each weight are at least approximately 85% thinner than the weight plates of each weight.

BRIEF DESCRIPTION OF THE DRAWINGS

This invention will be described more specifically in the following Detailed Description, when taken in conjunction with the following drawings, in which like reference numerals refer to like elements throughout.

DETAILED DESCRIPTION

Referring first to FIGS. 1-4, a selectorized dumbbell according to a first embodiment of this invention is generally illustrated as 2. Dumbbell 2 as shown herein is similar in some ways to existing selectorized dumbbells known as the PowerBlock® and Big Block which are manufactured and sold by PowerBlock, Inc. of Owatonna, Minn. Such existing selectorized dumbbells are shown in the Applicants' U.S. Pat. No. 5,769,762, which is hereby incorporated by reference.

Figure 2:
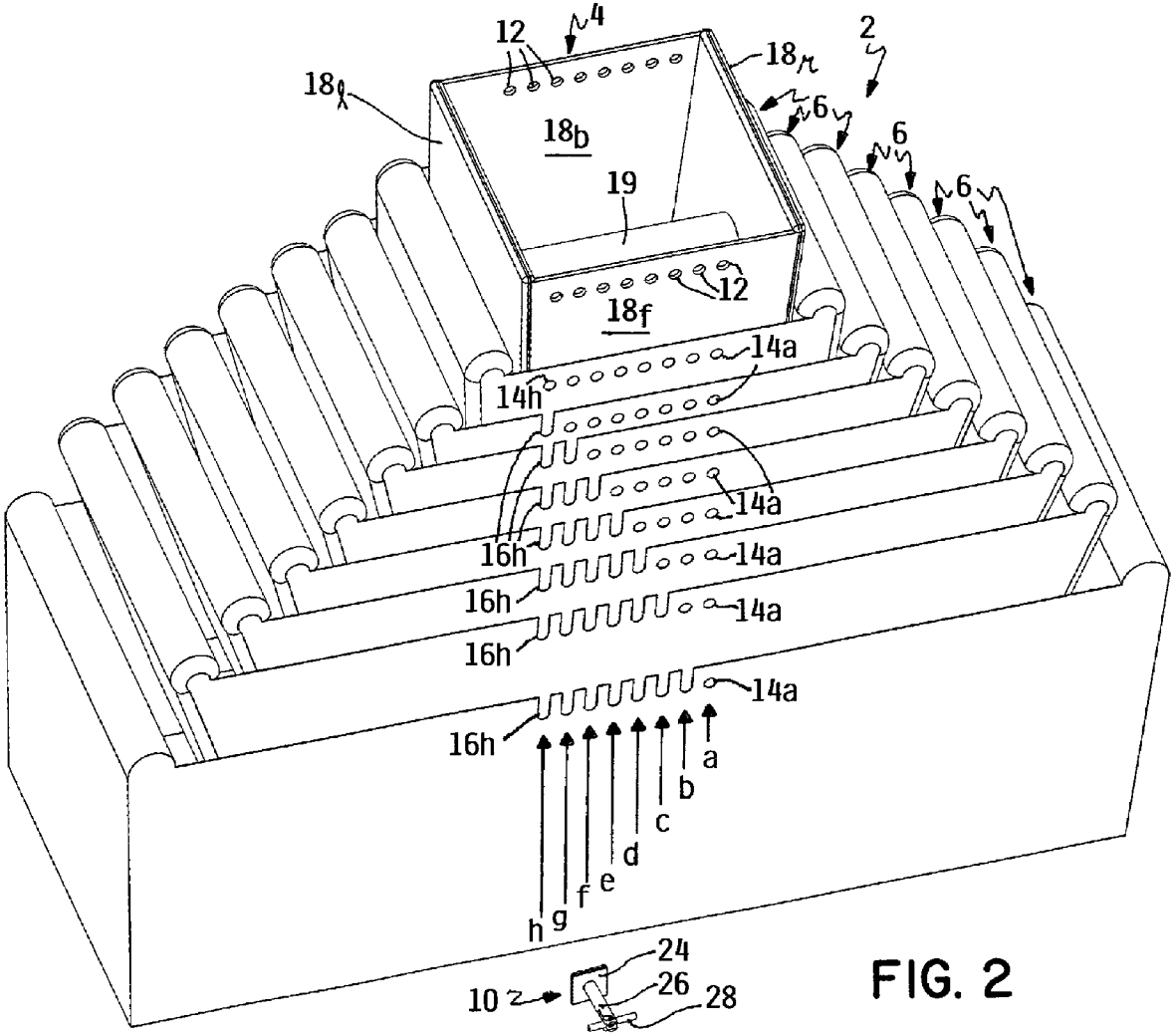
FIG. 2 is an exploded perspective view of the dumbbell of FIG. 1, particularly illustrating the handle and the various weights that can be selectively thereto in a partially exploded form to more clearly illustrate the various unique sets of holes and slots in the weights as well as one of the cuff link type selectors used in conjunction with any selected single one of the sets of holes and slots for coupling a selected number of weights to the handle.

Dumbbell 2 includes a handle 4 and eight nested weights 6 which can be selectively coupled to handle 4 using a selector 8. Selector 8 comprises a pair of cuff link style connecting pins 10, the operation of which will be described more fully hereafter. Referring to FIG. 2, each connecting pin 10 can be moved between one of eight different positions on handle 4 to pass through one of eight different holes 12 contained in a horizontal array of holes 12 on each of the front and rear sides of handle 4. Weights 6 are provided with various sets a-h of holes 14 and slots 16 in different combinations, e.g. a far right set a having eight holes 14*a*, a far left set h having one hole 14*h* and seven slots 16*h*, and the remaining sets b-g adding one more slot 16 and one less hole 14 as one goes from set b to set g. See FIG. 2 which illustrates the various sets a-h of holes 14 and slots 16 in the various weights 6.

Handle 4 is a box shaped member having a left wall $\mathbf{18}_l$ and a right wall $\mathbf{18}_r$ joined together by a front wall $\mathbf{18}_f$ and a back wall $\mathbf{18}_b$. Handle 4 has an open top and open bottom, though the bottom could be closed by a bottom wall if so desired. Handle 4 has an elongated hand grip 19 extending horizontally between and being rigidly secured to a central portion of the left and right walls $\mathbf{18}_l$ and $\mathbf{18}_r$. The user can insert his or her hand down through the open top of handle 4 to grasp hand grip 19 when it is desired to lift handle 4 to use dumbbell 2. The arrays of holes 12 contained in the front and back walls $\mathbf{18}_f$ and $\mathbf{18}_b$ extend in a horizontal line in the upper portions of the walls substantially immediately beneath the upper edges of walls $\mathbf{18}_f$ and $\mathbf{18}_b$. The location of the arrays of holes 12 is preferably above the horizontal elevation of the top of hand grip 19.

Figure 4:
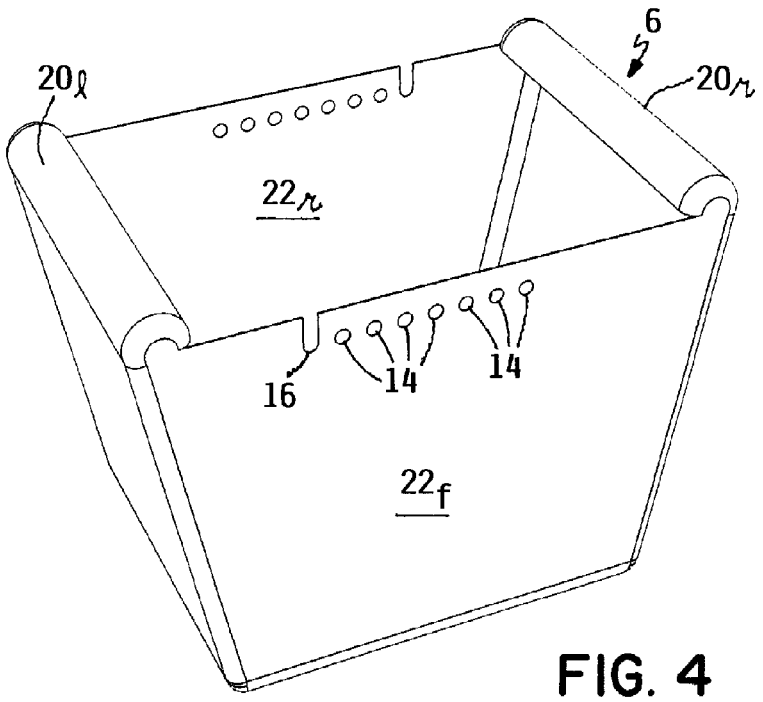
FIG. 4 is a perspective view of one of the weights of the dumbbell of FIG. 1.

Referring to FIG. 4, each weight 6 also has a box shaped configuration similar to that of handle 4. Each weight 6 comprises a relatively thick (i.e. approximately ¼" to ½" in thickness) left weight plate $\mathbf{20}_l$ and right weight plate $\mathbf{20}_r$ joined together by a very thin (preferably between 0.020" to 0.035" in thickness), substantially planar, and substantially imperforate front connecting wall $\mathbf{22}_f$ and an identical rear connecting wall $\mathbf{22}_r$. In order to have sufficient strength given their very thin thicknesses, front and rear connecting walls $\mathbf{22}_f$ and $\mathbf{22}_r$ extend substantially over the full height of weight plates 20 and are preferably bonded to the edges of weight plates 20 along substantially the entire junction between connecting walls $\mathbf{22}_f$ and $\mathbf{22}_r$ and weight plates 20. Holes 14 and slots 16 in each weight 6 are formed in two identical arrays that extend in horizontal lines in the upper portions of each connecting wall substantially immediately beneath the upper edges of each connecting wall $\mathbf{22}_f$ and $\mathbf{22}_r$.

Weight plates 20 and connecting walls 22 could be formed of metal such as steel. In this case, connecting walls 22 would be welded to weight plates 20. Alternatively, weight plates 20 could be encapsulated inside a thin plastic covering and connecting walls 22 could be formed of a similar or compatible plastic. Such plastic connecting walls 22 would be glued, ultrasonically welded or rigidly attached in any other suitable manner to the plastic covering of weight plates 20. Given the thin thicknesses of connecting walls 22 as described earlier herein, connecting walls 22 would be flexible and resilient to provide dumbbell 2 with a degree of shock resistance should dumbbell 2 be dropped or banged against an external object.

Figure 1:
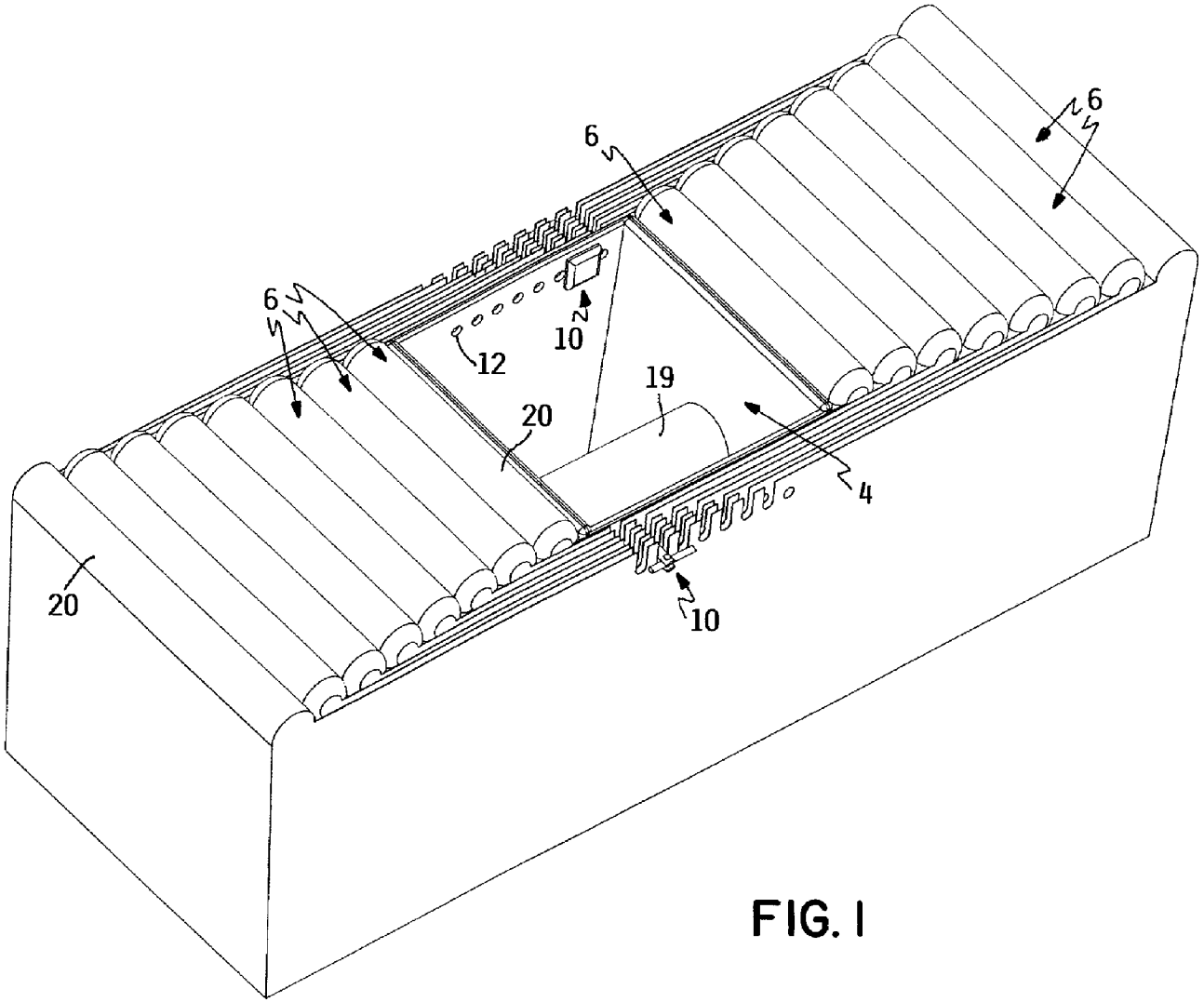
FIG. 1 is a perspective view of a first embodiment of a selectorized dumbbell according to this invention.
Figure 3:
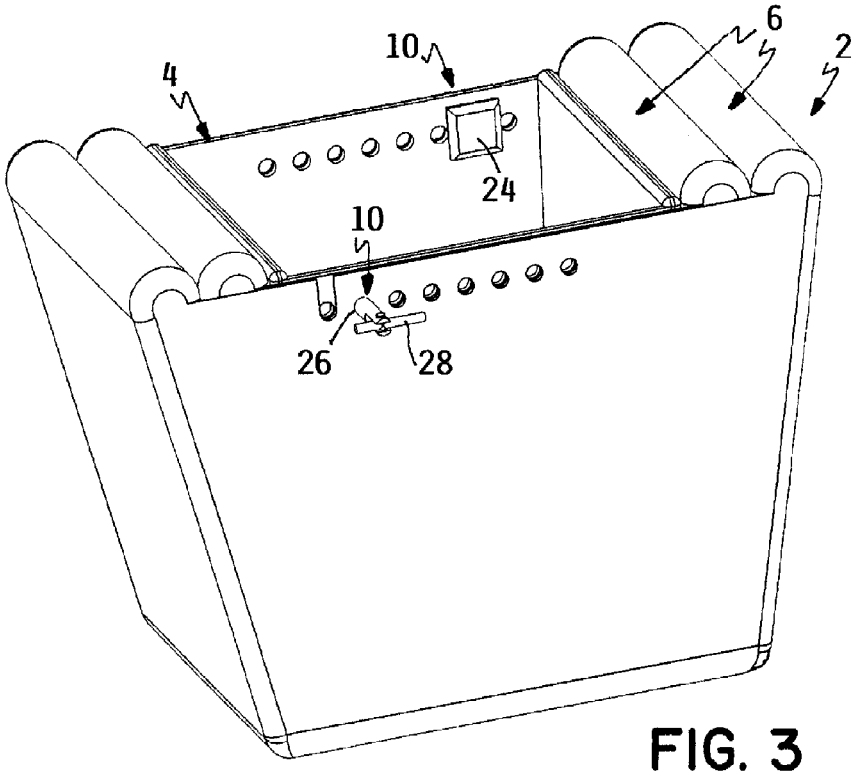
FIG. 3 is a perspective view of the dumbbell that would be provided when the cuff link selectors are in the position shown in FIGS. 1 and 3 in which two weights are selectively coupled to the handle.

Each connecting pin 10 has an enlarged head 24, an elongated shank 26, and a pivotal retention bar 28 at a free end of shank 26. When retention bar 28 is pivoted to be aligned with the axis of shank 26, shank 26 can be passed through one of the sets a-h of holes 14 and slots 16 in weights 6 and through the corresponding hole 12 in handle 4 that is aligned with the selected set of holes 14 and slots 16. Shank 26 can be passed therethrough in either direction, i.e. with enlarged head 24 being inside handle 4 and shank 26 passing outwardly through handle 24 and through weights 6 as shown in FIGS. 1 and 3 or vice versa. Once shank 26 is passed through the selected set a-h of holes 14 and slots 16 and through a corresponding hole 12 in handle 4, retention bar 28 can be manually pivoted by the user in the manner of a cuff link to a position in which retention bar 28 is perpendicular to the axis of shank 26 to secure connecting pin 10 in place. Obviously, since there are two connecting pins 10, one pin 100 is used on the overlying front connecting walls $\mathbf{22}_f$ and the holes 12 on front wall $\mathbf{18}_f$ of handle 4 and the other pin 10 is used in the same position in the overlying rear connecting walls $\mathbf{22}_r$ and the holes 12 on back wall $\mathbf{18}_b$ of handle 4.

A desired number of weights 6 can be selectively coupled to handle 4 depending upon where connecting pins 10 are used. As an example, connecting pins 10 are shown in FIGS. 1-3 as having been inserted into sets g of holes 14 and slots 16 and through the holes 12 in the front and back walls $\mathbf{18}_f$ and $\mathbf{18}_r$ that align with sets g. When so inserted into this second position, the first two weights 6 will be coupled to handle 4 for use with handle 4 since set g contains long two holes 14. If a greater number of weights are desired, connecting pins 10 would be shifted to any of the remaining sets f-a of holes 14 and slots 16 to add one additional weight 6 at each set, e.g. set f will couple three weights 6 to handle 4, set e will couple 4 weights, and so on. If fewer weights are desired, then set h would be used to couple only the innermost weight 6 to handle 4. The operation of the various sets of holes 14 and slots 16 are further described in the Applicants' U.S. Pat. No. 5,769,762 which has previously been incorporated by reference herein.

Dumbbell 2 as described herein is advantageous in that the very thin thicknesses of connecting walls $\mathbf{22}_f$ and $\mathbf{22}_r$ do not substantially expand the overall front to back depth of dumbbell 2 compared to known PowerBlock® selectorized dumbbells. In such known dumbbells, the front and rear rails had a ¼" diameter. Even though there are now eight connecting walls 22 that are horizontally stacked relative to one another with such connecting walls being approximately 0.020 to 0.035 inches thick, the collective thickness of all eight walls 22 together now is only approximately 0.18 inches to 0.30 inches thick allowing for 0.002 inches of clearance between walls 22. Thus, dumbbell 2 is not substantially any deeper or longer than it was before in the PowerBlock® product, even though it uses horizontally stacked connecting walls 22 rather than vertically stacked rails.

Moreover, the center of gravity of dumbbell 2 remains substantially constant in horizontal elevation even as the number of weights 6 attached to handle 4 varies. The phenomenon of more mass being added at progressively lower elevations as additional weight plates 6 are added is no longer present. The center of gravity 2 of dumbbell 2 does not similarly change since the mass in connecting walls 22 is evenly distributed in all connecting walls 22 with respect to a horizontal reference plane. Thus, the user will not feel a substantial difference when using dumbbell 2 no matter how many weights 6 are attached to handle 4.

Finally, the various sets a-h of holes 14 and slots 16 are in the very uppermost portions of connecting walls 22 with connecting walls 22 being substantially full height walls. This allows the dual connecting pins 10 that comprise selector 8 to be used at the top of dumbbell 2 when making the weight selection or adjustment no matter how many weights 6 are being selected. It is easier for the user to manipulate and insert connecting pins 10 than trying to insert a connecting pin at the very bottom of dumbbell 2 just above a support surface or stand on which dumbbell 2 is resting.

Figure 5:
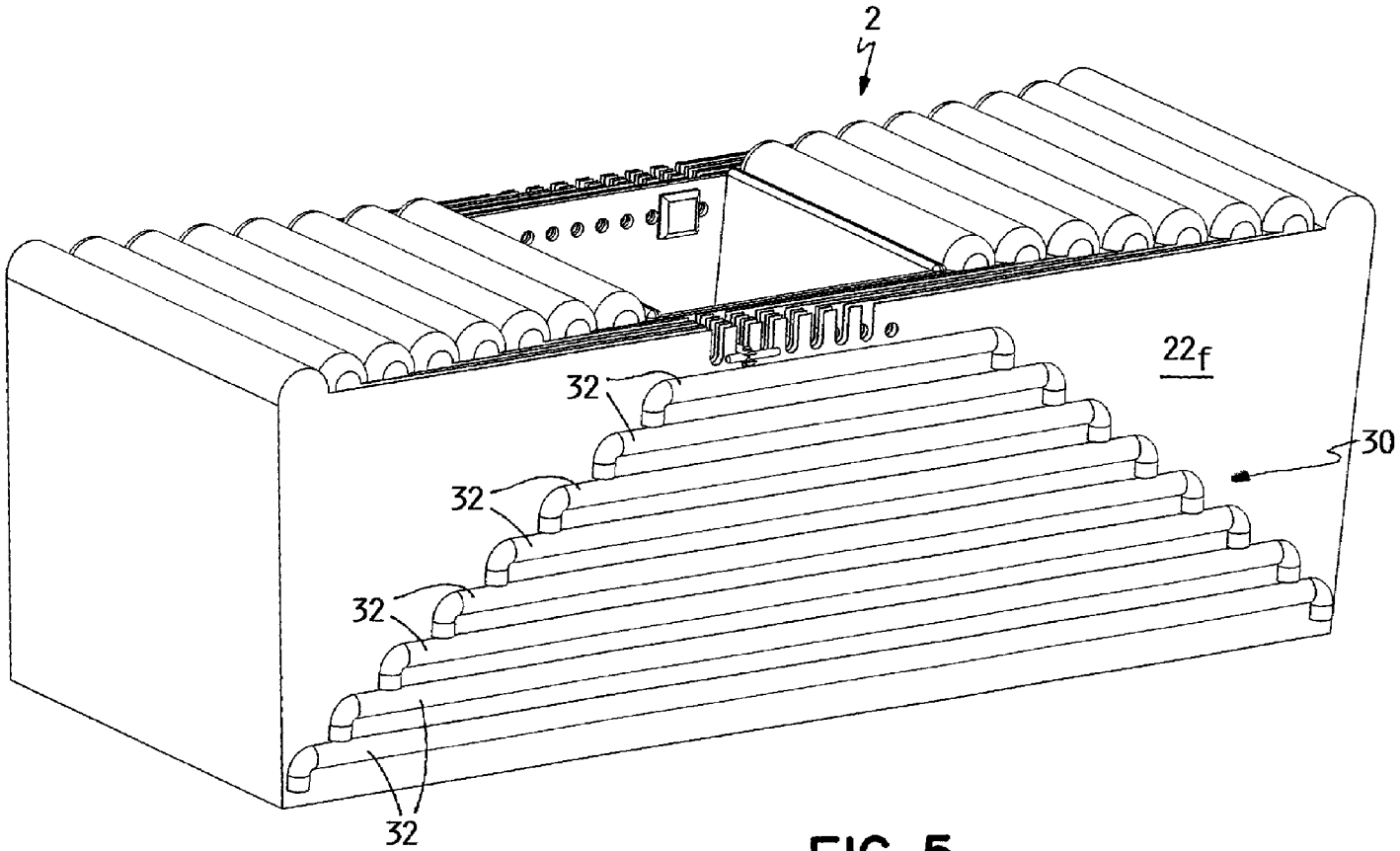
FIG. 5 is a perspective view of a second embodiment of a selectorized dumbbell according to this invention, particularly illustrating the dumbbell of FIG. 1 and a three-dimensional decorative motif that is formed in the connecting walls of the outermost weight.

Referring now to FIG. 5, a three dimensional motif, indicated generally as 30, can optionally be used on the outer face of connecting walls $\mathbf{22}_f$ and $\mathbf{22}_r$ of the outermost weight 6 of dumbbell 2. Motif 30 in one form can comprise a representation of the decorative shape of rails 32 as used in traditional selectorized PowerBlock® dumbbells of the type shown in U.S. Pat. No. 5,637,064. Many other motifs could be used in place of motif 30 as shown herein. Forming motif 30 atop outer face of connecting walls $\mathbf{22}_f$ and $\mathbf{22}_r$ or embossing it within the thickness of connecting walls $\mathbf{22}_f$ and $\mathbf{22}_r$ breaks up the planar look of dumbbell 2 as it is stored on a stand or support and provides it with a more attractive appearance. In addition, in the case of the particular motif 30 shown herein, motif 30 causes dumbbell 2 to resemble the appearance of its more traditional counterpart. Motif 30 and rails 32 that comprise one form of motif 30 are purely decorative and have no functional purpose.

Motif 30 could be used only on the outermost weight 6 thereof as this weight 6 is always visible when dumbbell 2 or the unused portions of dumbbell 2 are racked on a support stand. However, a similar version of motif 30 could be used on connecting walls $\mathbf{22}_f$ and 22 of all the weights 6 with the exception that the bottom rail used in motif 30 on the weight 6 that is outside of and adjacent to the weight 6 in question would be deleted from motif 30 for the weight 6 in question. For example, if a motif 30 like that shown in FIG. 5 were used on the next weight 6 inside of the outermost weight 6 that is shown, only the top seven rails 32 in motif 30 would be used on the next weight 6, then the only the top six rails 32 for the next inner weight, then only the top five rails 32 for the next inner weight, and so on.

Figure 6:
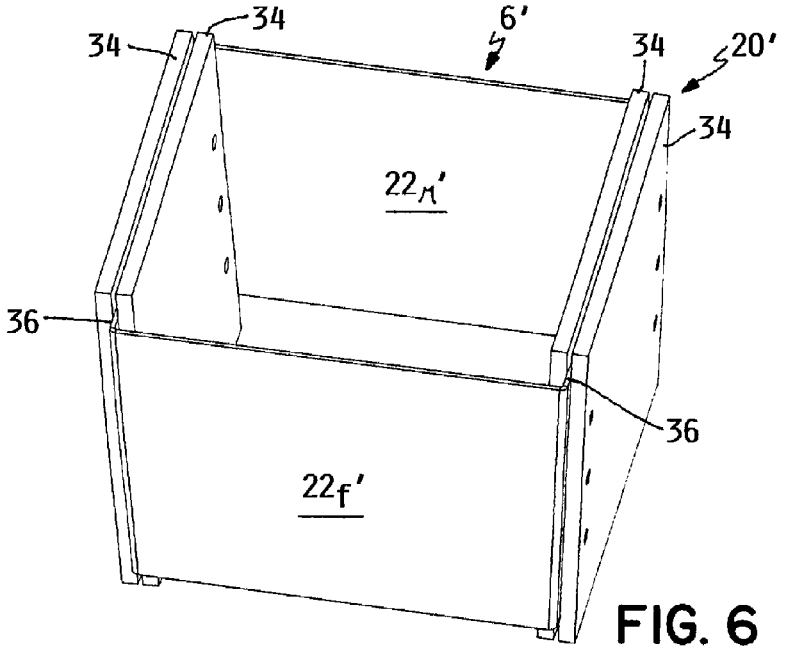
FIG. 6 is a perspective view of a first alternative weight that may be used in the dumbbell of FIG. 1.
Figure 7:
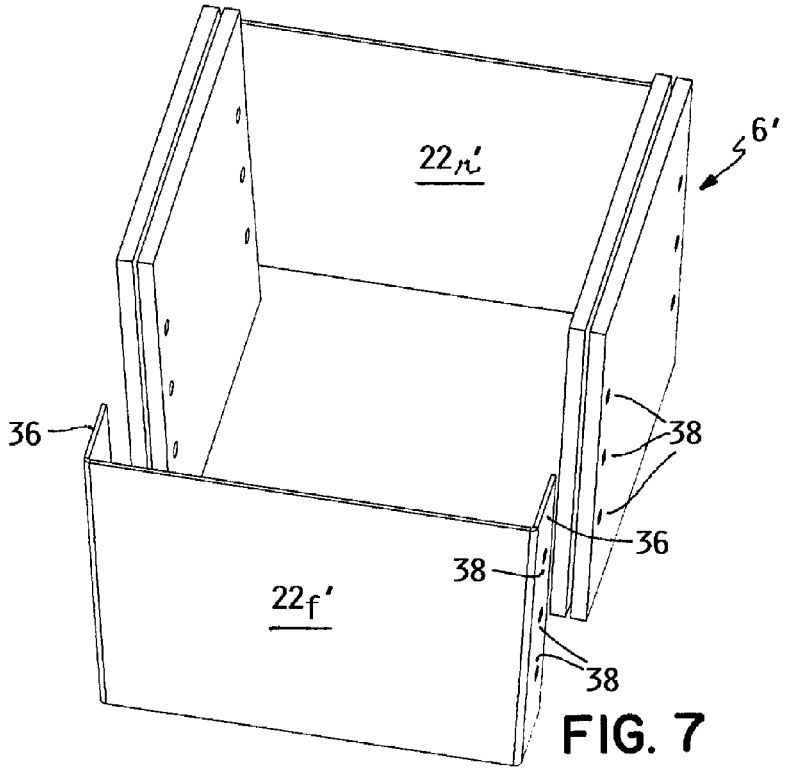
FIG. 7 is a partially exploded view of the first alternative weight of FIG. 6.

FIGS. 6 and 7 show an alternative weight 6' for dumbbell 2. Note that holes 14 and slots 16 have been omitted in the illustration of weight 6' for the sake of simplicity. Weight 6' will be described using the same reference numerals as those used with respect to weight 6 except with a prime designation, i.e. weight 6' instead of weight 6.

In weight 6', each weight plate 20' is now formed as two separate weight sub-plates 34. Front and rear connecting walls $\mathbf{22}_f'$ and $\mathbf{22}_r'$ are still substantially planar, imperforate and full height walls, but have inwardly turned attachment flanges 36. Attachment flanges 36 can be inserted between weight sub-plates 34 to be tightly sandwiched therebetween with a plurality of attachment holes 38 in attachment flanges 36 and weight sub-plates 34 being aligned with one another. Front and rear connecting walls $\mathbf{22}_f'$ and $\mathbf{22}_r'$ can then be fastened together by a plurality of fasteners (not shown), such as bolts, with pass through the aligned attachment holes. FIG. 6 shows weight 6' in an assembled form while FIG. 7 shows weight plate 6' in a partially exploded form with front connecting wall $\mathbf{22}_f'$ having been pulled away from the weight sub-plates 34.

Figure 8:
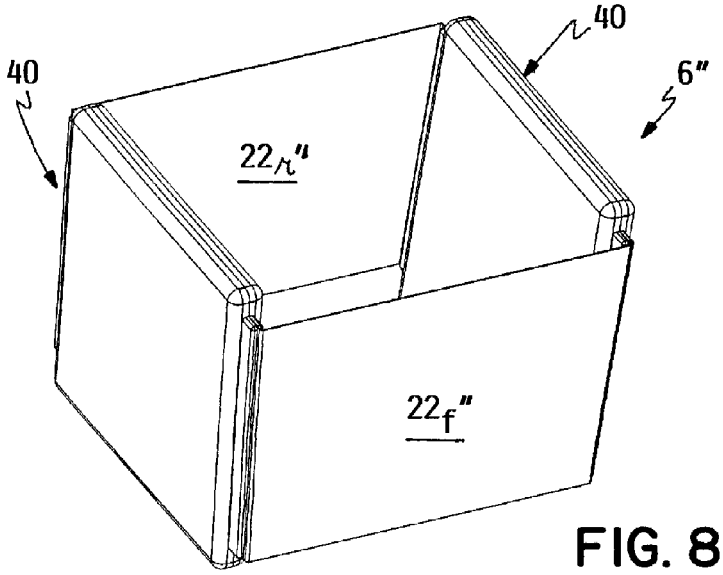
FIG. 8 is a perspective view of a second alternative weight that may be used in the dumbbell of FIG. 1.
Figure 9:
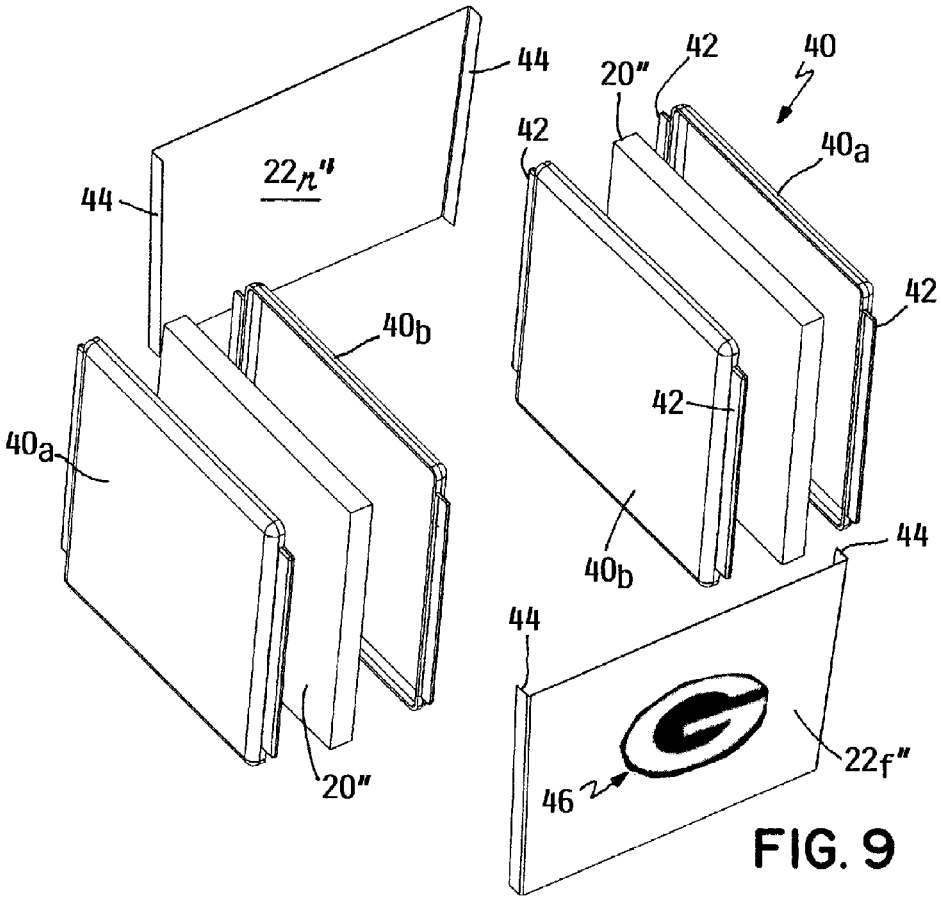
FIG. 9 is an exploded view of the second alternative weight of FIG. 8, particularly illustrating a two-dimensional logo applied to the connecting walls of the second alternative weight.

Similarly, FIGS. 8 and 9 show another alternative weight 6" for dumbbell 2. Again, note that holes 14 and slots 16 have been omitted from the illustration of weight 6" for the sake of simplicity. Weight 6" will be described using the same reference numerals as those used with respect to weight 6 except with a double prime designation, i.e. weight 6" instead of weight 6. Weight 6" will be most effective with components that are made of plastic except for weight plates 20" that are preferably made of metal such as steel.

Referring to FIG. 9, each weight plate 20" is encased within a two part plastic clamshell 40 made of generally identical clamshell halves $\mathbf{40}_a$ and $\mathbf{40}_b$. Clamshell halves $\mathbf{40}_a$ and $\mathbf{40}_b$ each have forwardly and rearwardly extending mounting flanges 42 that are adjacent the parting line of clamshell halves $\mathbf{40}_a$ and $\mathbf{40}_b$ along the front and rear sides of clamshell halves $\mathbf{40}_a$ and $\mathbf{40}_b$. When clamshell halves $\mathbf{40}_a$ and $\mathbf{40}_b$ are affixed together in any suitable fashion, e.g. by ultrasonic plastic welding, flanges 42 will be spaced from one another by a small gap. Each front and rear connecting wall $\mathbf{22}_f$" and $\mathbf{22}_r$" has an inwardly projecting attachment flange 44 at each of the front and rear sides thereof that can be inserted into the small gap between mounting flanges 42. Attachment flanges 44 can then also be affixed to mounting flanges 42 in any suitable fashion, e.g. by gluing, ultrasonic welding, etc.

FIG. 8 shows the ultrasonically welded, plastic clamshell/plastic front and back connecting wall structure of weight 6" in a fully assembled form. FIG. 9 shows the same weight 6" in an exploded form so that the weight plates 20" that are normally encased in clamshell halves $\mathbf{40}_a$ and $\mathbf{40}_b$ are visible. Also, as shown in FIG. 9, two dimensional logos of various organizations, such as professional sports teams, could be painted, printed, or applied via decals to any of the outer faces of any of the walls of weights 6, 6' or 6". As an example thereof, FIG. 9 shows the logo 46 of the Green Bay Packers applied to the front connecting wall $\mathbf{22}_f$" of weight 6". This would allow for personalization of the dumbbell to a particular user or purchaser.

Figure 10:
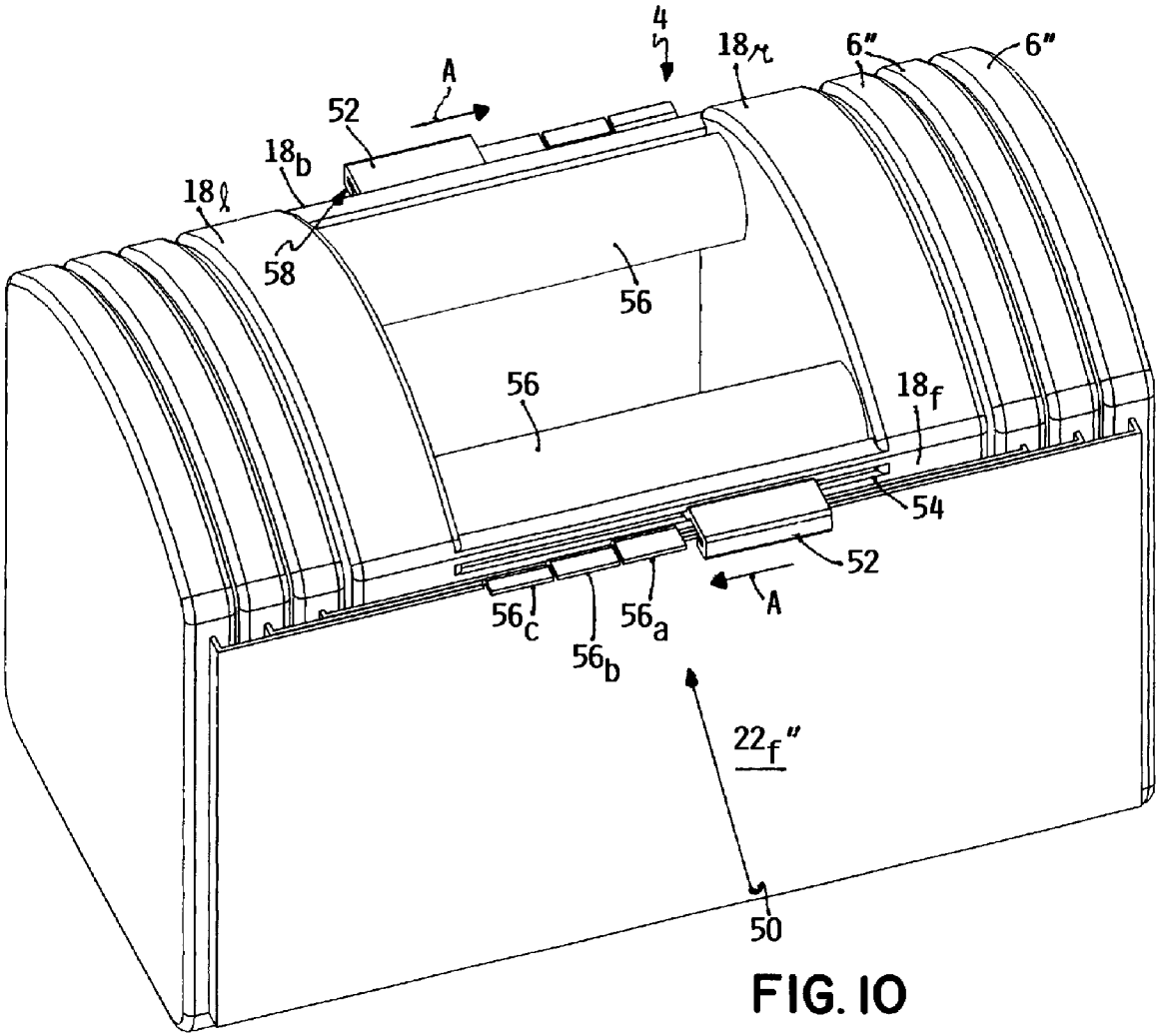
FIG. 10 is a perspective view of a third embodiment of a selectorized dumbbell according to this invention, particularly illustrating a zip lock type selector that can be used to selectively couple a desired number of weights to the handle.
Figure 11:
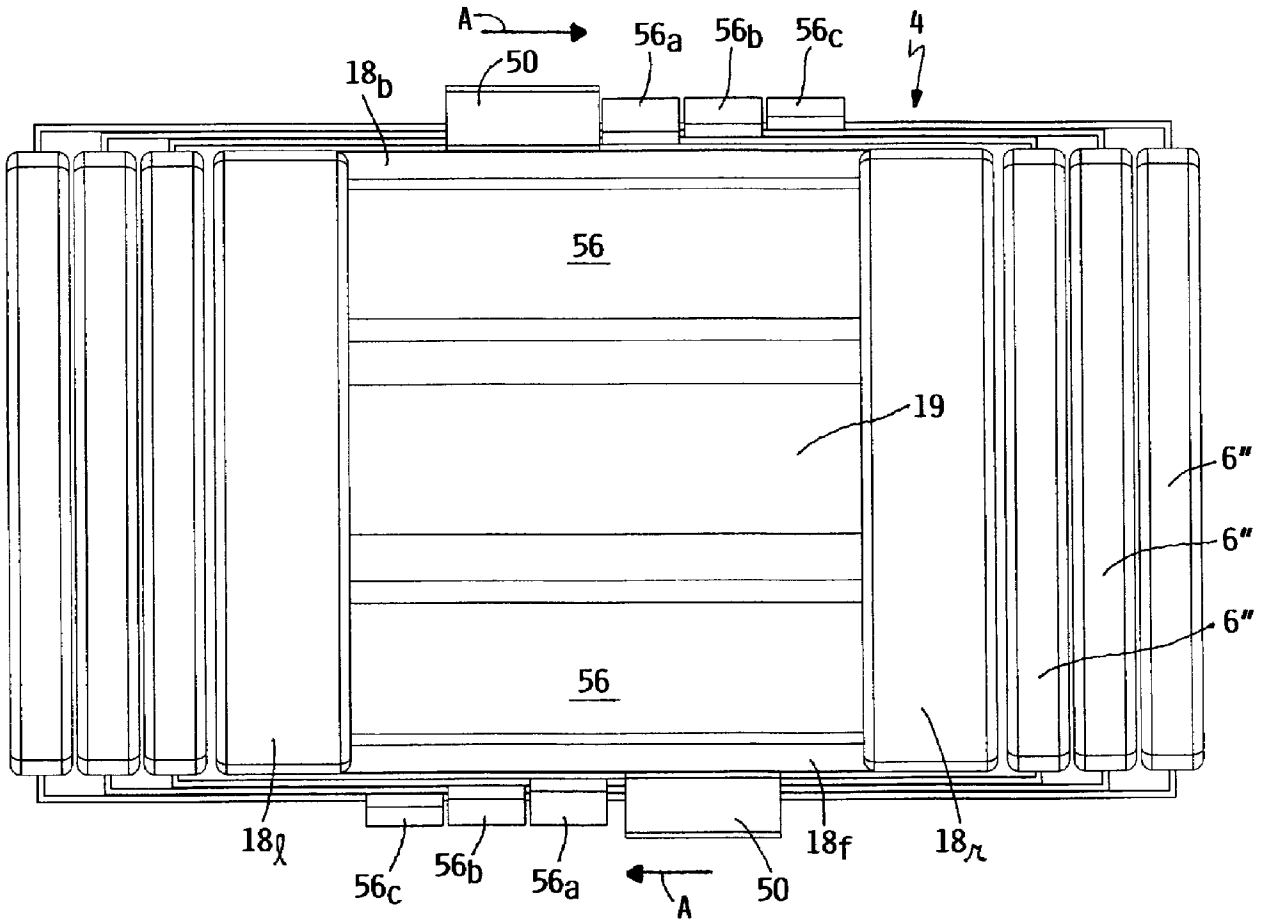
FIG. 11 is a top plan view of the dumbbell of FIG. 10.
Figure 12:
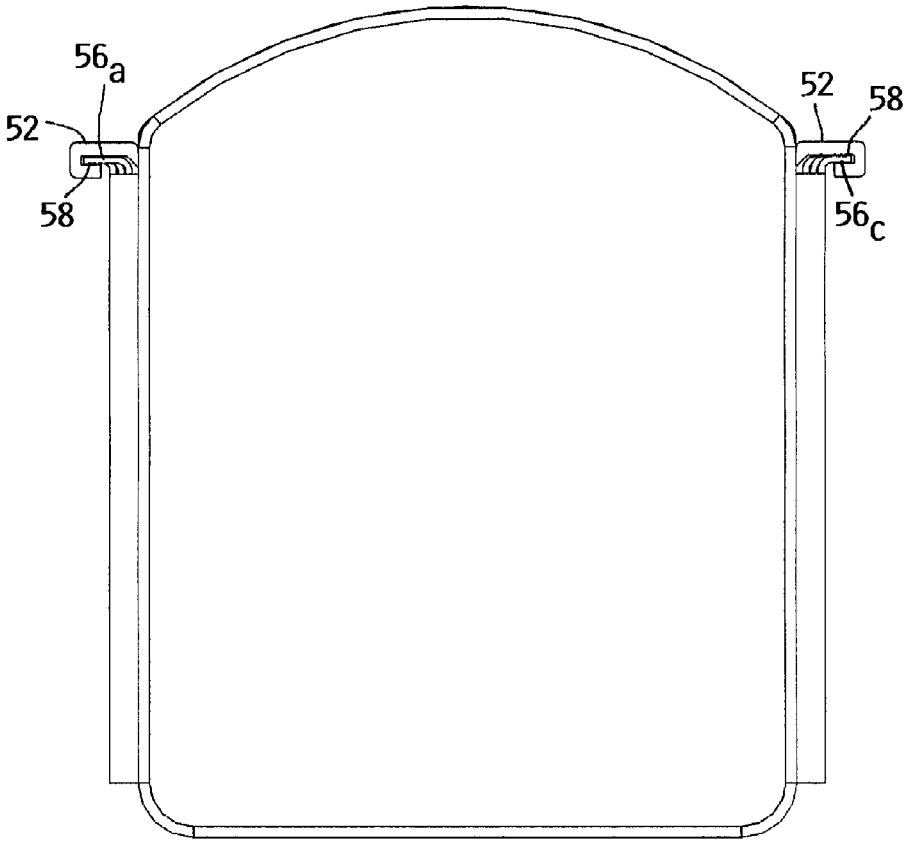
FIG. 12 is a side elevational view of the dumbbell of FIG. 10.

Referring now to FIGS. 10-12, an alternative selector 50 is shown for use with any dumbbell 2 having any of weights 6, 6' or 6". Selector 50 preferably comprises two slide members 52 that are zip lock type connectors. Zip lock connectors 52 slide horizontally back and forth in horizontal slideways 54 formed in the front and back walls $\mathbf{18}_f$ and $\mathbf{18}_b$ of handle 4 shown in FIGS. 10-12 substantially immediately below the upper edges of the front and back walls $\mathbf{18}_f$ and $\mathbf{18}_b$ of handle 4.

Handle 4 as shown in FIGS. 10-12 is somewhat different than handle 4 shown in FIGS. 1-4, having thicker left and right side walls $\mathbf{18}_l$ and $\mathbf{18}_r$ as well as a number of upper and lower cross tubes 56 at the corners of side walls $\mathbf{18}_l$ and $\mathbf{18}_r$ for additional strength. Hand grip 19 is still centrally located in handle 4 and can be reached by the user by extending his or her hand down between the upper cross tubes 56 to reach hand grip 19. See FIG. 11.

Each of the front and rear connecting walls $\mathbf{22}_f$" and $\mathbf{22}_r$" of each weight 6" has an outwardly extending tab 56 along the upper edge thereof. Tabs 56 on all weights 6" collectively are at the same vertical height, extend outwardly from the upper edge of wall $\mathbf{22}_f$" or $\mathbf{22}_r$" approximately the same horizontal distance, but are horizontally staggered relative to one another to be in a substantially side-by-side orientation. In the example shown in FIGS. 10-12 of three weights 6", tab $\mathbf{56}_a$ on the innermost weight 6" is most centrally located, tab $\mathbf{56}_b$ on the next weight 6" is displaced to be horizontally next to but outside of tab $\mathbf{56}_a$, and finally tab $\mathbf{56}_c$ the outermost weight 6" is further displaced horizontally to be next to but outside of tab 56*b*. All three tabs $\mathbf{56}_{a\text{-}c}$, when viewed from above as shown in FIG. 11 are in a horizontal row that extends laterally.

Referring now to FIG. 12, each zip lock connector 52 has an inwardly extending gripping slot 58 that is sized to slide over and tightly grip each tab $\mathbf{56}_{a\text{-}c}$, in turn. This is similar to zip lock technology used for sealing the mouths of plastic bags together. When each zip lock connector 52 is displaced from all of tabs $\mathbf{56}_{a\text{-}c}$, then no weights 6" are coupled to handle 4. If each zip lock connector 52 is displaced in the direction of arrows A in FIGS. 10 and 11 such that each connector 52 slides over and grips the first tab $\mathbf{56}_a$, then just the first weight 6" is coupled to handle 4. The second and third weights 6" get progressively added to handle 4 as zip lock connectors 52 are progressively slid in further increments to cover and pick up tabs $\mathbf{56}_b$ and $\mathbf{56}_c$. Note that each zip lock connector 52 is long enough to eventually grip and thus pick up all three tabs $\mathbf{56}_{a\text{-}c}$.

Selector 50 as disclosed herein is extremely easy to use and works well with substantially full height connecting walls $\mathbf{22}_f$" or $\mathbf{22}_r$" in each weight 6". Preferably, connecting walls $\mathbf{22}_f$" or $\mathbf{22}_r$", tabs $\mathbf{56}_{a\text{-}c}$, thereon, and zip lock connectors 52 are made of plastic which is sufficiently pliable so that slots 58 in connectors 52 tightly compress tabs $\mathbf{56}_{a\text{-}c}$, as connectors 52 slide over tabs $\mathbf{56}_{a\text{-}c}$, to form a tight gripping engagement.

Various modifications of this invention will be apparent to those skilled in the art. Thus, the scope of this invention is not to be limited to the details of the various embodiments of the invention disclosed herein.

The invention claimed is:

1. A selectorized dumbbell, which comprises:

(a) a handle;

(b) a plurality of nested weights;

(c) a selector for selectively coupling a desired number of weights to the handle depending upon a position of the selector relative to the nested weights and handle; and (d) each weight having a box-shaped configuration defined by a left weight plate and a right weight plate joined together by substantially planar and substantially imperforate front and rear connecting walls, wherein each of the front and rear connecting walls of each weight has a height that extends substantially over a full height of the weight plates of each weight, wherein the front and rear connecting walls are joined to front and rear edges, respectively, of the weight plates, and wherein the box-shaped configurations of the plurality of nested weights have progressively decreasing sizes that allow the box-shaped configurations to be nested inside of one another with the left weight plates being stacked adjacent one another, with the right weight plates being stacked adjacent one another, with the front connecting walls being stacked adjacent one another, and with the rear connecting walls being stacked adjacent one another.

2. The dumbbell of claim 1, wherein the front and rear connecting walls are joined to the front and rear edges, respectively, of the weight plates along substantially the entire height of the front and rear connecting walls.

3. The dumbbell of claim 1, wherein the front and rear connecting walls have thicknesses that are approximately 0.020 inches to 0.035 inches and the weight plates have thicknesses that are least approximately 0.250 inches to 0.500 inches.

4. The dumbbell of claim 1, wherein the front and rear connecting walls of each weight are at least approximately 85% thinner than the weight plates of each weight.

5. The dumbbell of claim 1, wherein the handle comprises a box shaped member having a left wall and a right wall joined together by a front wall and a back wall, wherein the handle is sized to be nested inside the plurality of nested weights and when so nested the front wall of the handle is inside of and adjacent to the stacked front connecting walls of the nested weights and the rear wall of the handle is inside of and adjacent to the stacked rear connecting walls of the nested weights.

6. The dumbbell of claim 1, wherein the selector comprises:

(a) a front connecting member coacting between a front wall of the handle and the front connecting walls of the desired number of nested weights that are to be coupled to the handle; and (b) a rear connecting member coacting between a rear wall of the handle and the rear connecting walls of the desired number of nested weights that are to be coupled to the handle, the front and rear connecting members being separate from one another.

7. The dumbbell of claim 6, wherein the front and rear connecting members when in use are located adjacent upper portions of the front and rear connecting walls of the nested weights.

8. The dumbbell of claim 7, wherein the handle includes a hand grip, and wherein the front and rear connecting members when in use are located above the hand grip of the handle.

9. The dumbbell of claim 6, wherein the front and rear connecting members are cuff link type members having an enlarged head, an elongated shank, and a pivotal retention bar at a free end of the shank, each cuff link type member requiring manual insertion by the user into one of a plurality of alternative weight coupling positions provided therefor when the pivotal retention bar is aligned with the shank followed by locking of the cuff link type member in the selected weight coupling position by manual pivoting of the retention bar on the shank into an orthogonally disposed orientation relative to the shank.

10. The dumbbell of claim 6, wherein the front and rear connecting members are zip lock type members that slide horizontally back and forth in portions of the front and back walls of the handle below upper edges of the front and back walls of the handle, each zip lock type member requiring manual sliding by the user into one of a plurality of alternative weight coupling positions provided therefor.

11. The dumbbell of claim 1, further including a three-dimensional decorative motif that is formed on exterior surfaces of the front and rear connecting walls of at least the outermost weight.

12. A selectorized dumbbell, which comprises:

(a) a handle;

(b) a plurality of nested weights;

(c) a selector for selectively coupling a desired number of weights to the handle depending upon a position of the selector relative to the nested weights and handle; and (d) each weight having a box-shaped configuration defined by a left weight plate and a right weight plate joined together by substantially planar front and rear connecting walls, wherein each of the front and rear connecting walls of each weight has a height that extends substantially over a full height of the weight plates of each weight, and wherein the front and rear connecting walls of each weight are at least approximately 85% thinner than the weight plates of each weight.

13. The dumbbell of claim 12, wherein the front and rear connecting walls have thicknesses that are approximately 0.020 inches to 0.035 inches and the weight plates have thicknesses that are least approximately 0.250 inches to 0.500 inches.

* * * * *